US010340587B2

(12) United States Patent
Nugent et al.

(10) Patent No.: US 10,340,587 B2
(45) Date of Patent: Jul. 2, 2019

(54) ANTENNA ASSEMBLIES HAVING SEALED CAMERAS

(71) Applicant: Laird Technologies, Inc., Earth City, MO (US)

(72) Inventors: Brian Nugent, Fenton, MI (US); Hasan Yasin, Grand Blanc, MI (US)

( * ) Notice: Subject to any disclaimer, the term of this patent is extended or adjusted under 35 U.S.C. 154(b) by 244 days.

(21) Appl. No.: 15/432,092

(22) Filed: Feb. 14, 2017

(65) Prior Publication Data

US 2018/0076514 A1 Mar. 15, 2018

Related U.S. Application Data

(60) Provisional application No. 62/393,825, filed on Sep. 13, 2016.

(51) Int. Cl.

| | |
|---|---|
| ***H01Q 1/42*** | (2006.01) |
| ***H01Q 1/32*** | (2006.01) |
| ***H01Q 1/12*** | (2006.01) |
| ***H01Q 9/04*** | (2006.01) |

(Continued)

(52) U.S. Cl.

CPC ..... *H01Q 1/42* (2013.01); *H01Q 1/1214* (2013.01); *H01Q 1/3275* (2013.01); *H01Q 5/371* (2015.01); *H01Q 9/0407* (2013.01); *H01Q 9/32* (2013.01)

(58) Field of Classification Search

CPC ..... H01Q 1/42; H01Q 5/371; H01Q 1/1214; H01Q 1/3275; H01Q 9/0407; H01Q 9/32

See application file for complete search history.

(56) References Cited

U.S. PATENT DOCUMENTS

| | | | |
|---|---|---|---|
| 7,990,325 | B2 | 8/2011 | Hunton et al. |
| 8,558,886 | B1 | 10/2013 | Borjas |
| 9,024,804 | B2 | 5/2015 | Shi et al. |

(Continued)

FOREIGN PATENT DOCUMENTS

| | | | |
|---|---|---|---|
| CN | 201522273 | | 7/2010 |
| CN | 104979631 | A | 10/2015 |

(Continued)

OTHER PUBLICATIONS

International Search Report and Written Opinion for PCT/US2017/051358 filed Sep. 13, 2017 which claims priority to the instant application, dated Nov. 29, 2017, 11 pages.

*Primary Examiner* — Dieu Hien T Duong

(74) *Attorney, Agent, or Firm* — Harness, Dickey & Pierce, P.L.C.; Anthony G. Fussner

(57) ABSTRACT

An antenna assembly includes a camera, a plug, and a radome. The radome is configured to house one or more antennas. The radome defines an opening extending between its interior surface and its exterior surface. The camera is positionable at least partially within the opening of the radome. The camera and the radome define a passage between the radome and the camera when the camera is positioned at least partially within the opening of the radome. The plug defines an opening extending between its interior plug surface and its exterior plug surface to receive at least a portion of the camera. The plug is positionable at least partially within the passage to substantially prevent contaminants from passing into the radome via the opening of the radome. Other antenna assemblies and methods relating to antenna assemblies are also disclosed.

20 Claims, 7 Drawing Sheets

(51) Int. Cl.
*H01Q 9/32* (2006.01)
*H01Q 5/371* (2015.01)

(56) References Cited

U.S. PATENT DOCUMENTS

| | | | | |
|---|---|---|---|---|
| 2014/0158731 | A1* | 6/2014 | Squire | B60R 11/04 224/545 |
| 2014/0354064 | A1 | 12/2014 | Tseliakhovich | |
| 2015/0188226 | A1 | 7/2015 | Ng et al. | |
| 2016/0104932 | A1 | 4/2016 | Aminzadeh et al. | |
| 2017/0033449 | A1 | 2/2017 | Talty et al. | |
| 2017/0214130 | A1* | 7/2017 | Grimes | H01Q 1/3275 |

FOREIGN PATENT DOCUMENTS

| | | | |
|---|---|---|---|
| CN | 204793188 | | 11/2015 |
| DE | 102009012615 | A1 | 9/2010 |
| DE | 202014004364 | U1 | 8/2014 |
| DE | 102013019226 | A1 | 5/2015 |
| DE | 102016006802 | A1 | 12/2016 |
| KR | 1020100137883 | | 12/2010 |
| KR | 101052796 | B1 | 7/2011 |
| KR | 200455494 | Y1 | 9/2011 |
| KR | 2020120000248 | U | 1/2012 |
| KR | 1020130056435 | | 5/2013 |
| KR | 2020120000680 | B1 | 8/2013 |
| KR | 101550715 | B1 | 9/2015 |
| WO | WO-2015003384 | A1 | 1/2015 |
| WO | WO-2016093084 | A1 | 6/2016 |

* cited by examiner

ANTENNA ASSEMBLIES HAVING SEALED CAMERAS

CROSS-REFERENCE TO RELATED APPLICATION

This application claims priority to and the benefit of U.S. Provisional Patent Application No. 62/393,825 filed Sep. 13, 2016. The entire disclosure of the referenced application is incorporated herein by reference.

FIELD

The present disclosure relates to antenna assemblies having sealed cameras.

BACKGROUND

This section provides background information related to the present disclosure which is not necessarily prior art.

An antenna assembly generally includes a radome and one or more antennas housed within the radome. Sometimes, the antenna assembly can include a camera. In some cases, a vehicle can include an antenna assembly and cameras separated from each other. Typically, the cameras are positioned in various locations on the vehicle.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Example embodiments will now be described more fully with reference to the accompanying drawings.

Figure 1:
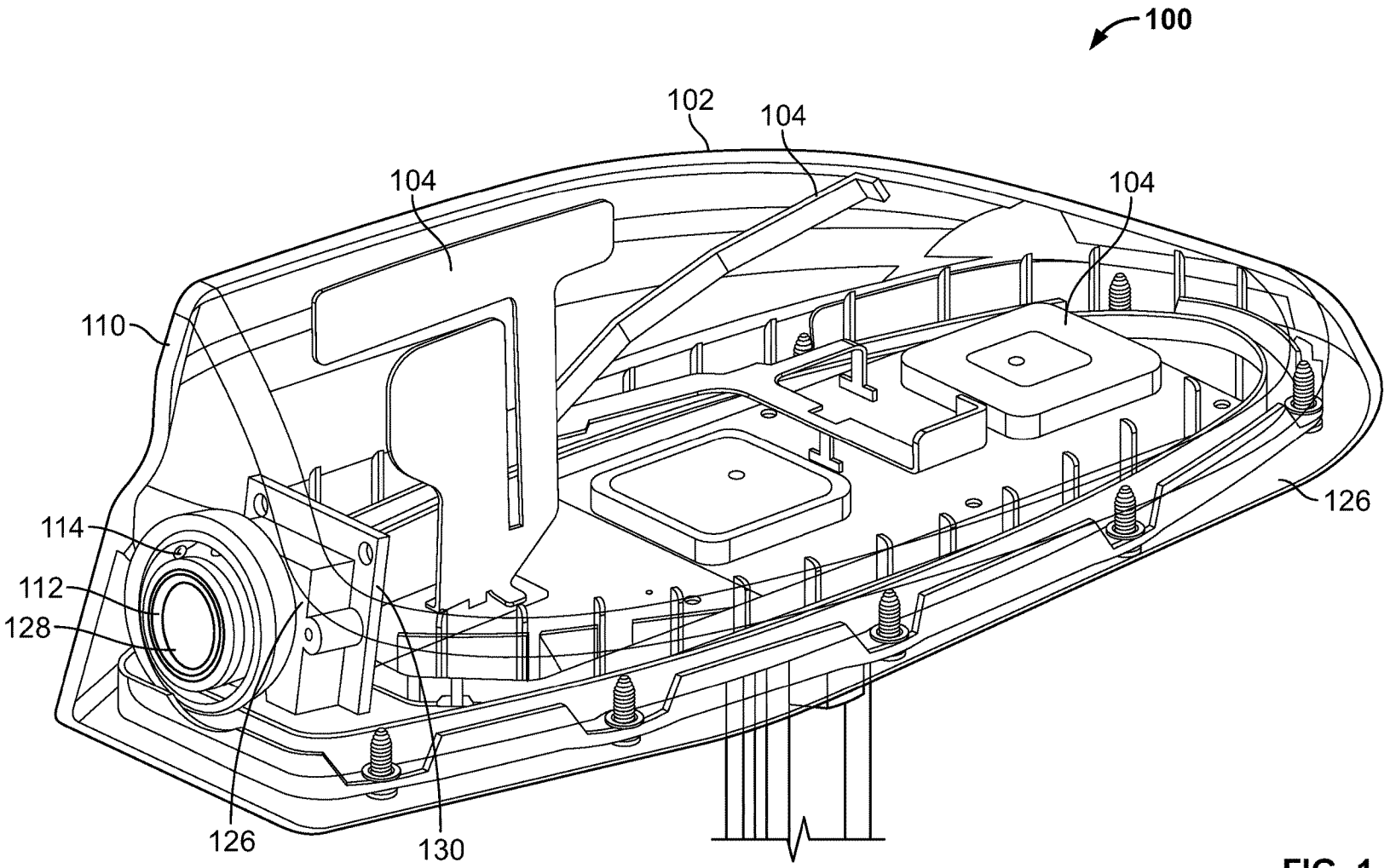
FIG. 1 is an isometric view of an antenna assembly including a radome having an opening, and a plug and a camera positioned in the radome's opening according to one example embodiment of the present disclosure.
Figure 2:
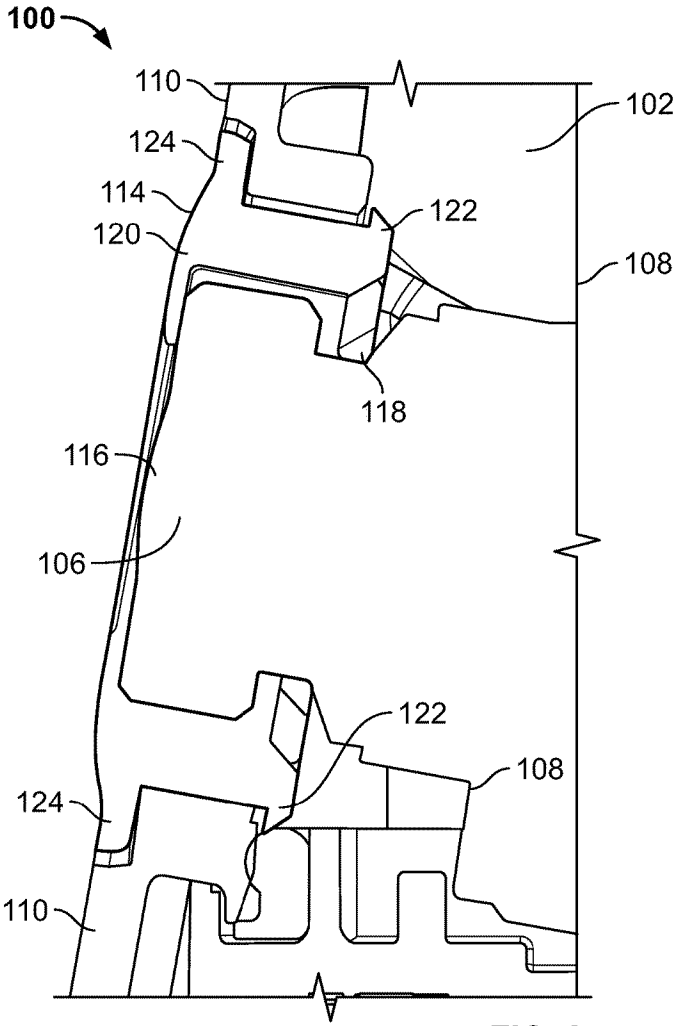
FIG. 2 is a cross-sectional partial side view of the antenna assembly of FIG. 1.

An antenna assembly according to one example embodiment of the present disclosure is illustrated in FIGS. 1 and 2, and indicated generally by reference number 100. As shown in FIGS. 1 and 2, the antenna assembly 100 includes a radome 102 for housing one or more antennas 104 and defining an opening 106 extending between its interior surface 108 and its exterior surface 110, and a camera 112 positionable at least partially within the opening 106 of the radome 102. The camera 112 and the radome 102 define a passage between the radome 102 and the camera 112. The antenna assembly 100 further includes a plug 114 defining an opening 116 extending between its interior plug surface 118 and its exterior plug surface 120 to receive at least a portion of the camera 112.

The plug 114 is positionable at least partially within the passage to substantially prevent contaminants from passing into the radome via the opening of the radome. As such, contaminants such as debris (e.g., dirt, dust, etc.), moisture, etc. that may otherwise enter the antenna assembly 100 through openings between the radome 102 and the camera 112 are restricted from entering the antenna assembly 100, and damaging components housed in the antenna assembly 100.

In some embodiments, the plug 114 may be coupled to the radome 102. In such examples, the plug 114 may be detachably coupled to the radome 102 via one or more components of the plug 114 and/or the radome 102. For example, and as shown in FIG. 2, the plug 114 may include flanges 122, 124 for detachably coupling the plug 114 to the radome 102.

The flanges 122 and the flanges 124 may be located on opposing plug surfaces 118, 120 of the plug 114. Specifically, the flanges 122 are located on the interior plug surface 118 of the plug 114 and are detachably coupled with a portion of the interior surface 108 of the radome 102. Likewise, the flanges 124 are located on the exterior plug surface 120 of the plug 114 and are detachably coupled with a portion of the exterior surface 110 of the radome 102.

In the particular example of FIGS. 1 and 2, the flanges 122 are resilient. For example, a user such as an individual, machine, etc. can manipulate (e.g., bend, etc.) the flanges 122 to couple the plug 114 to the radome 102. After which, the flanges 122 can return to their non-manipulated state (e.g., a steady state). If it is desired to remove the plug 114, the user can again manipulate the flanges 122 to decouple the plug 114 from the radome 102. This allows the plug 114 to snap into and/or out of place when coupled to the radome 102.

Additionally and/or alternatively, the flanges 124 may be resilient to assist in coupling and/or decoupling the plug 114 to and/or from the radome 102.

In the specific example of FIGS. 1 and 2, the flanges 122 and the flanges 124 extend around an outer perimeter of the plug 114. For example, the plug 114 of FIGS. 1 and 2 is circular shaped. As such, the flanges 122 and the flanges 124 extend (on opposing plug surfaces 118, 120) about the circumference of the plug 114.

In other embodiments, the plug 114 may be another suitable geometric shape and the flanges 122 and/or the flanges 124 may extend completely around the outer perimeter of that geometric shaped plug 114 or less than completely around the outer perimeter. For example, the flanges 122 and/or the flanges 124 may be segmented around the outer perimeter of the plug 114 if desired.

The plug 114 (and/or any other plug disclosed herein) may be formed by any other suitable process. For example, the plug 114 may be formed by injection molding. In such examples, the plug 114 may be formed separately from the radome 102, and then detachably coupled to the radome 102 as explained above. In other embodiments, the injection molded plug 114 may be formed on the radome 102 by overmolding the plug 114 onto the radome 102.

As shown in FIG. 1, the antenna assembly 100 includes a chassis 126 for supporting the radome 102 and/or one or more components. For example, the components (e.g., board level component(s), antenna(s), etc.) and the radome 102 may be coupled (e.g., attached, etc.) to one or more of the chassis' surfaces.

In some example embodiments, a portion of the camera 112 may be positioned in the radome's opening 106 without making contact with the radome 102. In such examples, the passage between the camera 112 and the radome 102 may extend substantially about the camera 112. For example, the passage may extend around a perimeter of the camera 112. In such examples, the plug 114 can extend completely around the perimeter of the camera 112 (and between the camera and the radome 102) to substantially prevent contaminants from entering the antenna assembly 100.

Alternatively, a portion of the camera 112 may be in contact with the radome 102 adjacent the radome's opening 106. As such, the plug 114 may extend around portions of the perimeter of the camera 112 not in contact with the radome 102 to substantially prevent contaminants from entering the antenna assembly 100 via the passage.

As shown in FIG. 1, the camera 112 is substantially flush with the exterior surface 110 of the radome 102. This allows the camera 112 to capture a desirable viewing area as further explained below without substantial obstructions from the radome 102. Additionally, the radome 102 can still provide at least some protection to the camera 112 (e.g., a lens 128 of the camera 112, etc.) from debris, etc. Alternatively, the camera 112 may be inset into the radome 102 to provide additional protection for the camera 112. This, however, may decrease the viewing area captured by the camera 112. In other example embodiments, the camera 112 may be at least partially extracted from the exterior surface 110 of the radome 102 such that the camera 112. As such, the viewing area captured by the camera 112 may be increased.

Figure 3:
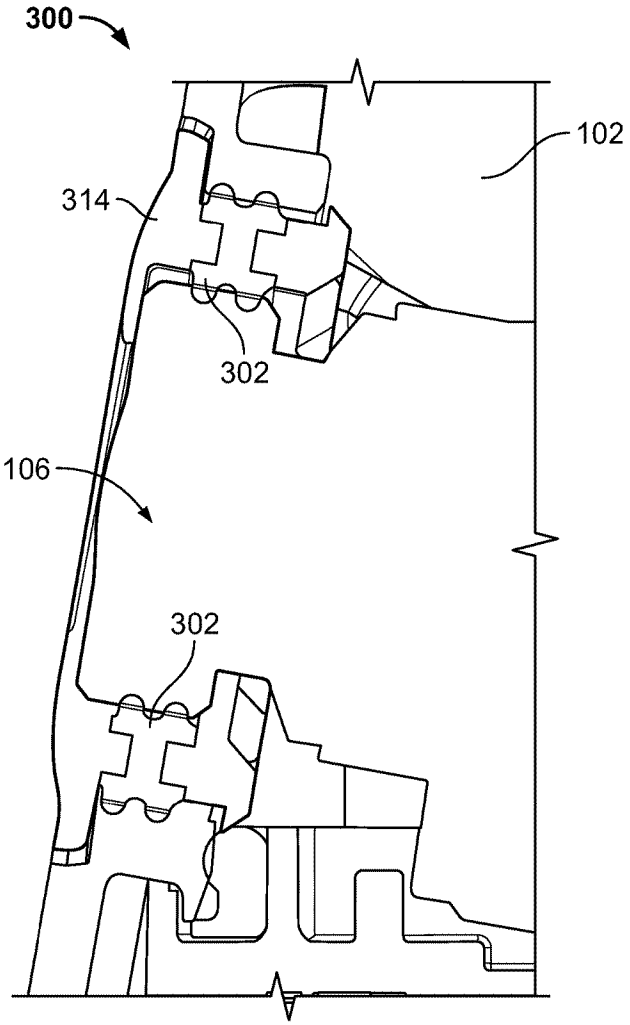
FIG. 3 is a cross-sectional partial side view of an antenna assembly similar to the antenna assembly of FIG. 1, but including a flexible seal positioned between the plug and the camera according to another example embodiment.

In some example embodiments, the antenna assembly 100 and/or another antenna assembly disclosed herein may include a flexible seal. For example, FIG. 3 illustrates an antenna assembly 300 including the radome 102 of FIGS. 1 and 2 having the opening 106 for receiving a camera (not shown), a plug 314 coupled to the radome 102 (as explained above), and a flexible seal 302 positionable between the plug 314 and the camera. The plug 314 of FIG. 3 is substantially similar to the plug 114 of FIGS. 1 and 2, but is shaped differently to accommodate the seal 302.

Similar to the plug 314, the seal 302 substantially prevents contaminants from passing into the radome 102 via its opening 106. For example, the seal 302 may be formed of a flexible material (as further explained below) to allow the seal 302 to conform to surfaces of adjacent components such as the plug 314, the camera, etc. As such, the seal 302 can function as a gasket when employed. This conformability allows the seal 302 to absorb a greater tolerance of the camera relative to the radome 102 and/or the plug 312 when the camera is positioned in the radome's opening 106 compared to embodiments not employing the seal 302.

In the specific example of FIG. 3, the seal 302 extends completely around an outer perimeter of the camera and/or an inner perimeter of the plug 312 to substantially prevent contaminants from passing into the radome 102. This can provide a friction fit between the seal 302 and a casing of the camera. In other embodiments, the seal 302 may be segmented if, for example, the plug 314 provides a sufficient seal with the camera to prevent contaminants from entering the antenna assembly 300.

The flexible seal 302 (and/or any other seals plug disclosed herein) may be formed by any other suitable process. For example, the seal 302 may be formed by injection molding such as overmolding. As such, the seal 302 may be molded directly on the plug 314 (if overmolding is employed), molded separately from the plug 314 and then coupled to the plug 314 such that the seal is positioned between the camera and the plug (when installed), etc. The flexible seal 302 may include outwardly protruding portions or protrusions (e.g., bumps, etc.) extending outwardly from opposing sides of the flexible seal 302 as shown in FIG. 3. The bumps or protrusions may be made out of a flexible material, such as silicon, etc. During assembly, the bumps or protrusions may be compressed to seal the antenna assembly 300 at the camera location.

Figure 4:
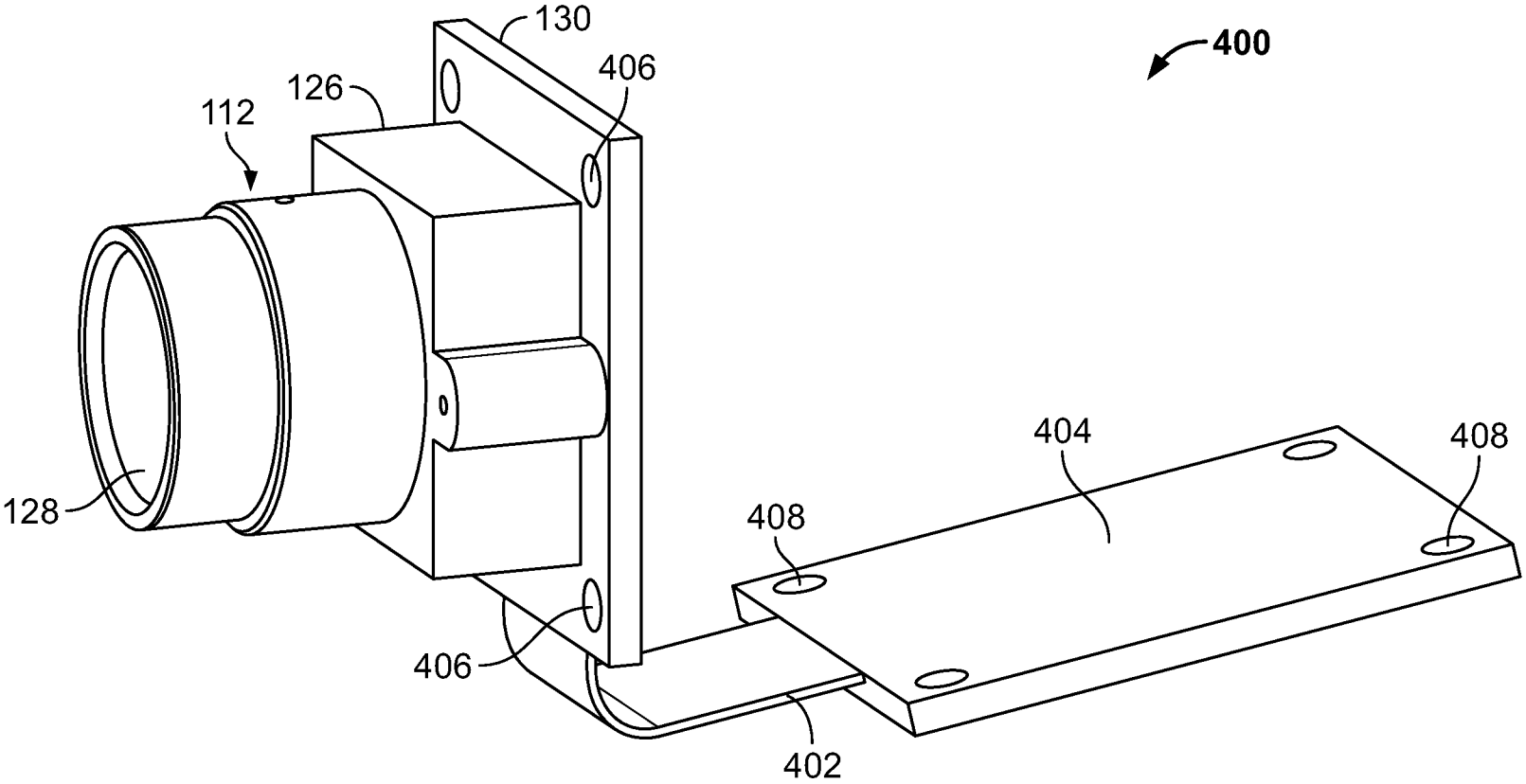
FIG. 4 is an isometric view of a camera assembly including two rigid printed circuit boards and one flexible circuit board employable in an antenna assembly according to yet another example embodiment.

The cameras disclosed herein may be a part of a camera assembly for one or more antenna assemblies. For example, FIG. 4 illustrates a camera assembly 400 including three substrates and the camera 112 of FIG. 1 coupled to one of the substrates. As shown in FIGS. 1 and 4, the camera 112 includes a lens 128 and a housing 132 for storing various components of the camera 112 (e.g., the lens 128, etc.).

In the particular example of FIG. 4, the substrates are printed circuit boards 130, 402, 404. As such, each printed circuit board 130, 402, 404 can include components (e.g., control circuits, interfaces, etc. as further explained below) and/or various traces coupling components, circuit boards, etc. Alternatively, the camera assembly 400 can include other suitable substrates including, for example, other circuit boards without departing from the scope of the disclosure.

The printed circuit boards 130, 402, 404 may be any suitable printed circuit board including, for example, rigid circuit boards, flexible circuit boards, etc. For example, in the particular example of FIG. 4, the printed circuit board 130, 404 are rigid circuit boards and the printed circuit board 402 is a flexible circuit board.

This configuration allows greater flexibility when installing the camera assembly 400. For example, the camera assembly 400 may be attached to different components of its antenna assembly. The flexible printed circuit board 402 allows for a greater tolerance in the camera assembly 400 (and in particular, the rigid printed circuit boards 130, 404) when the camera assembly 400 is installed.

For example, the rigid printed circuit board 130, which is coupled to the camera 112 (e.g., the housing 132 of the camera 112), can be attached to a radome (e.g., the interior surface 108 of the radome 102 of FIGS. 1 and 2). The rigid printed circuit board 404 may be coupled to another component such as, for example, a chassis (e.g., the chassis 126 of FIG. 1), etc. Thus, the flexible printed circuit board 402 can flex to allow the rigid printed circuit boards 130, 404 to attach to desirable components.

As shown in FIG. 4, the rigid circuit boards 130, 404 includes mounting holes 406, 408, respectively, for coupling the boards to the radome, the chassis, etc. Additionally and/or alternatively, the boards 130, 404 and/or the board 402 may be coupled to an antenna assembly in another suitable manner.

The lens 128 may be any suitable dimension and/or include various features. For example, the lens 128 may have a diameter of about 12 mm or less, and a depth of about 15 mm or less. Additionally, the lens 128 can have a field of view of about 180 degrees (horizontally) and about 60 degrees (vertically) depending on the position of the lens compared to the radome.

Likewise, the housing 132 can have any suitable dimension and/or include various features. For example, the housing 132 can have a length and a width of about 25 mm or less, and a depth of about 8 mm or less.

Additionally, although the circuit boards 130, 402, 404 are shown as rectangular shaped boards, it should be apparent to those skilled in the art that other suitable shaped boards may be employed. For example, one or more of the circuit boards 130, 402, 404 may be trapezoidal, triangular, circular, etc.

As explained above, the printed circuit boards 130, 402, 404 may include various components. These components may, for example, assist in capturing images, processing data, transferring data between the circuit boards, between the circuit boards and other components external an antenna assembly, etc. For example, FIG. 5 illustrates an electronic block diagram of the camera assembly 400 of FIG. 4.

Figure 5:
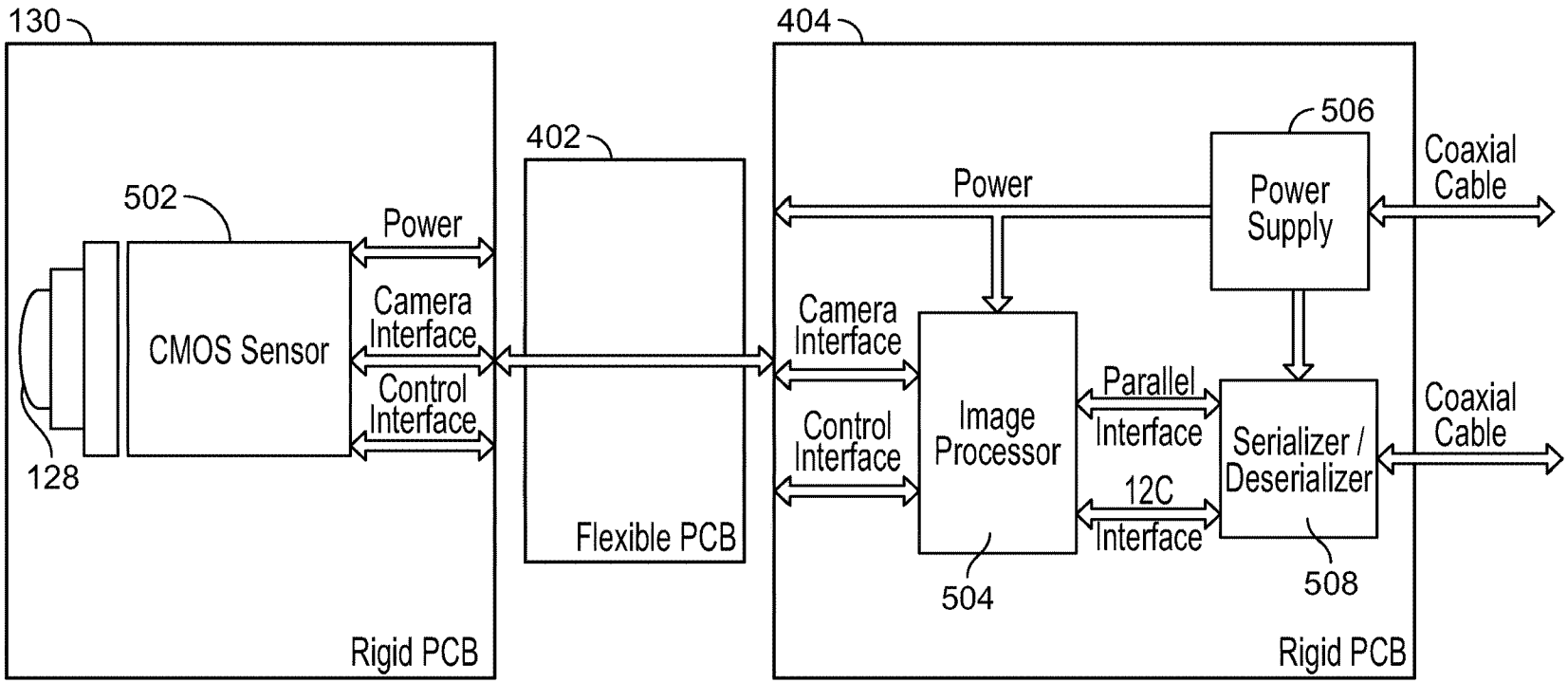
FIG. 5 is a block circuit diagram of the camera assembly of FIG. 4.

As shown in FIG. 5, the rigid circuit board 130 includes a complementary metal-oxide semiconductor (CMOS) sensor 502 for converting light (received through the lens 128) into electrons to produce one or more images. The rigid circuit board 404 includes control circuit (e.g., an image processor 504) for processing data into appropriate still images, a video, etc., sending/receiving data, and a power supply 506 for providing power to the camera and the image processor 504. Additionally and/or alternatively, the circuit boards 130, 404 may include other suitable components (e.g., a charge-coupled device (CCD) sensor, etc.).

The CMOS sensor 502 and/or the camera can be controlled by one or more signals provided by the image processor 504. For example, and as shown in FIG. 5, the rigid circuit boards 130, 404 include corresponding control interfaces for receiving and/or transmitting signals between the CMOS sensor 502 and the image processor 504. In such examples, the signals can control when the CMOS sensor 502, the camera, etc. is turned ON/OFF, provide data on camera features (e.g., automatic exposure, automatic white balance, flicker detection, etc.), etc.

Additionally, data can be transmitted between the image processor 504 and the CMOS sensor 502 via one or more signals. For example, the rigid circuit boards 130, 404 include corresponding camera interfaces for receiving and/or transmitting signals between the CMOS sensor 502 and the image processor 504. The image processor 504 can then process data received from the sensor 502 into appropriate still images, a video, etc. The lens 128 and the image sensor 502 may both be connected through a bus to the image processor 504 and the serializer 508. The camera may include all of the above.

If desired, the image processor 504 can provide data via one or more signals to other component(s) external the antenna assembly to display the still images, the video, etc. These signals can be provided over various different interfaces including, for example, parallel interfaces, analog interfaces, digital interfaces (e.g., HDMI, etc.). For example, if the antenna assembly is employed in a vehicle, the image processor 504 can provide one or more signals to a rearview mirror in the vehicle, a dash display, an aftermarket display, etc. so that the images, the video, etc. can be displayed. In other embodiments, the image processor 504 can provide one or more signals to a system vehicle controller.

The image processor 504 can provide data to and/or receive data from the other component(s) via a serializer/deserializer 508 that converts data between a serial data format and a parallel interfaces format. For example, data transmitted between the image processor 504 and the serializer/deserializer 508 may be in a parallel interfaces format (via a parallel interface as shown in FIG. 5), and data transferred and/or received by the serializer/deserializer 508 may be in a serial interfaces format.

Additionally, and as shown in FIG. 5, the image processor 504 may communicate with the serializer/deserializer 508 via an inter-integrated circuit (I2C) interface. This can allow the image processor 504, the serializer/deserializer 508 and/or other controllers (e.g., a system vehicle controller) to have a master-slave, etc. type relationship. Alternatively, the I2C interface may be removed and/or another suitable communication bus may be employed instead.

As shown in FIG. 5, a coaxial cable is used to provide power to the power supply 506 and another coaxial cable is used to transmit data between the serializer/deserializer 508 and other external component(s). Alternatively, one coaxial cable may be employed to provide power and transmit data if desired.

In some preferred embodiments, the image processor 504 may have a refresh rate up to about 45 frames per second (FPS) at 1080p, 60 fps at 720p, etc. Additionally, the image processor 504 may support color and/or gamma correction, adaptive local tone mapping (ALTM), graphical overlay, etc.

Figure 6:
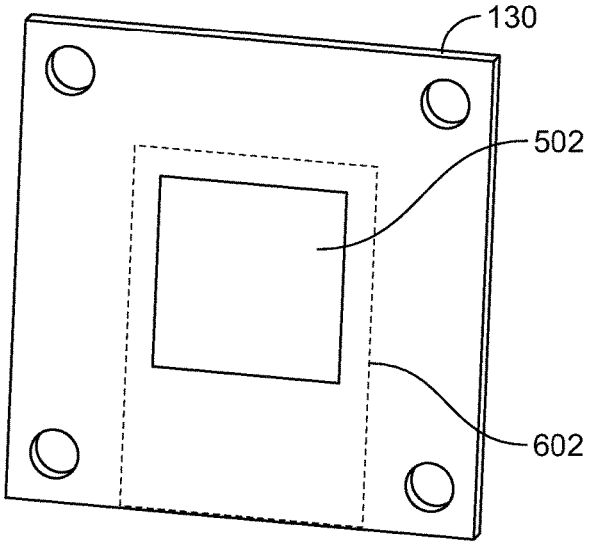
FIG. 6 is an isometric view of one of the rigid printed circuit boards of the camera assembly of FIG. 4.

In some embodiments, the CMOS sensor 502 can be placed adjacent a middle portion of a circuit board. For example, FIG. 6 illustrates the circuit board 130 including the CMOS sensor 502 positioned near a center of the board.

Additionally, it may be desirable to confine some or substantially all metal components on and/or in the board 130 within a particular area. This may reduce interference (e.g., electromagnetic interference (EMI), etc.) between the metal components and antennas housed in a particular antenna assembly. The particular confined area of the circuit board 130 is represented by dashed line 602. In other embodiments, other areas of a circuit board can be designated for metal components depending on, for example, the particular antenna assembly design.

Figure 7:
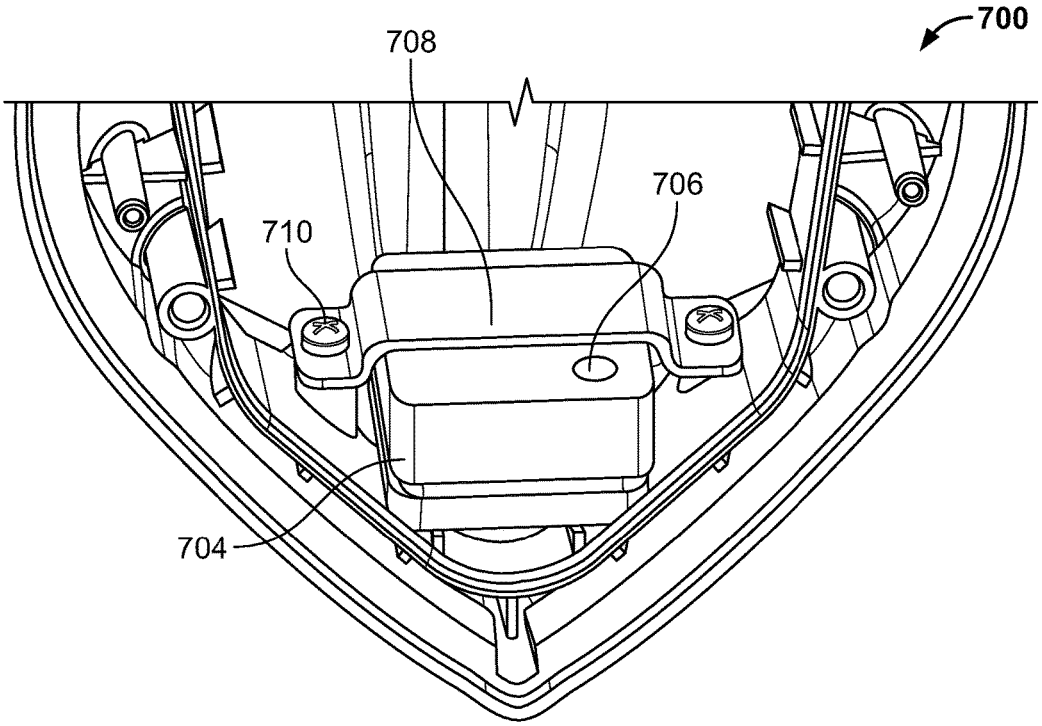
FIG. 7 is an isometric partial bottom view of an antenna assembly including a radome having an opening, a plug positioned in the radome's opening, and a camera housed in an enclosure according to another example embodiment.

In some embodiments, the camera assembly 400 and/or another suitable camera assembly may be housed in an enclosure. For example, FIG. 7 illustrates an antenna assembly 700 including a radome 702 substantially similar to the radome 102 of FIG. 1 and an enclosure 704 housing a camera, circuit boards (if employed), etc. Although not shown, the camera within the enclosure 704 can be positioned at least partially within an opening of the radome 702, as explained above.

As shown in FIG. 7, the enclosure 704 defines an opening 706 for receiving one or more cables. For example, the opening 706 may receive one coaxial cable, two coaxial cables (as shown in FIG. 5), etc. for providing power to components in the enclosure 704, transmitting data, etc.

Additionally, and as shown in FIG. 7, the enclosure 704 is coupled (e.g., attached, etc.) to the radome 702 via mechanical fasteners. Specifically, the enclosure 704 is coupled to the radome 702 via a bracket 708 and screws 710. Additionally and/or alternatively, other suitable mechanical fasteners may be employed if desired.

Figure 8:
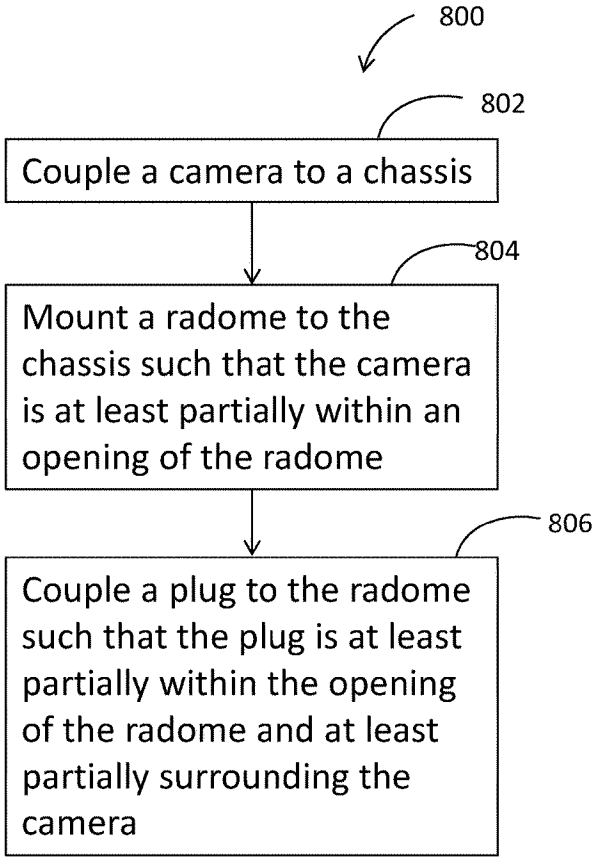
FIG. 8 is a flow diagram of a method relating to an antenna assembly according to yet another example embodiment.

The antenna assemblies disclosed herein may be assembled in any suitable manner. For example, FIG. 8 illustrates a method 800 relating to (e.g., assembling, manufacturing, etc.) an antenna assembly. As shown in FIG. 8, the antenna assembly is assembled by coupling (e.g., attaching, etc.) a camera to a chassis of the antenna assembly in block 802, mounting a radome of the antenna assembly to the chassis such that the camera is at least partially within an opening of the radome in block 804, and coupling a plug to the radome such that the plug is at least partially within the opening of the radome and at least partially surrounding the camera to substantially prevent contaminants from passing into the radome via the opening of the radome in block 806.

Figure 9:
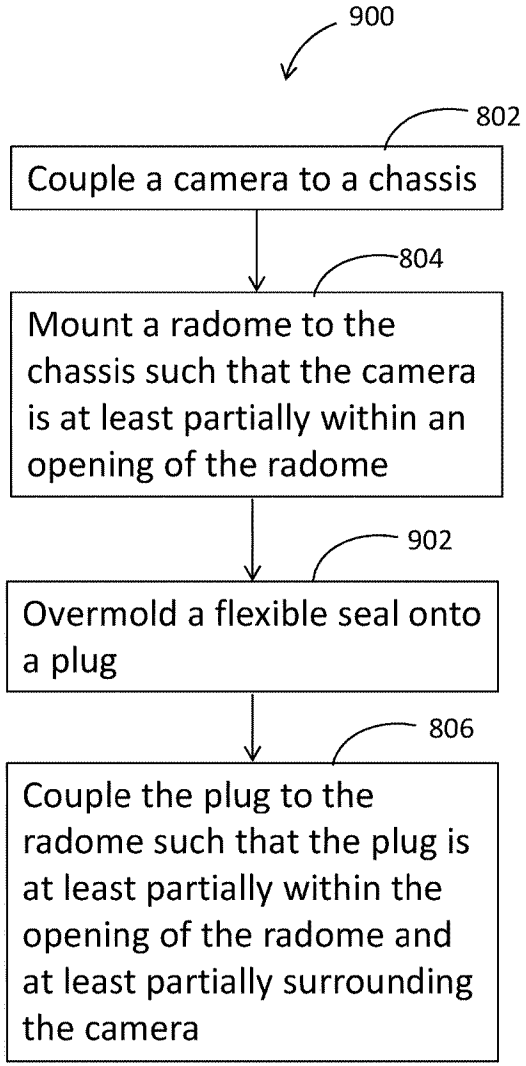
FIG. 9 is a flow diagram of a method relating to an antenna assembly including overmolding a flexible seal according to another example embodiment.

Additionally, in some embodiments, the antenna assembly may include a flexible seal as explained above. For example, FIG. 9 illustrates a method 900 relating to (e.g., assembling, manufacturing, etc.) an antenna assembly with a flexible seal. As shown, the method 900 includes the steps shown in blocks 802, 804 and 806 of FIG. 6 and coupling a flexible seal to the plug to substantially prevent contaminants from passing into the radome via the opening of the radome in block 902. In particular, and as shown in FIG. 9, the flexible seal is coupled to the plug by overmolding, as explained above. Alternatively, the flexible seal may be coupled to the plug by another suitable process if desired.

In some embodiments, it is preferable to complete the steps in a particular order. For example, the camera may be coupled (e.g., attached, etc.) to the chassis, and then the radome may be coupled to the chassis and the camera may be coupled to the radome. Additionally, the plug may be coupled to the radome after mounting the radome to the chassis. Further, the flexible seal may be coupled (e.g., overmolded, etc.) to the plug before coupling the plug to the radome. This may prevent the seal from unnecessarily compressing until the camera is coupled to the radome and/or chassis which in turn may improve seal performance.

In other embodiments, the flexible seal may be coupled to the plug after coupling the plug to the radome, the plug may be coupled to the radome before mounting the radome to the chassis, etc. if desired.

Figure 10:
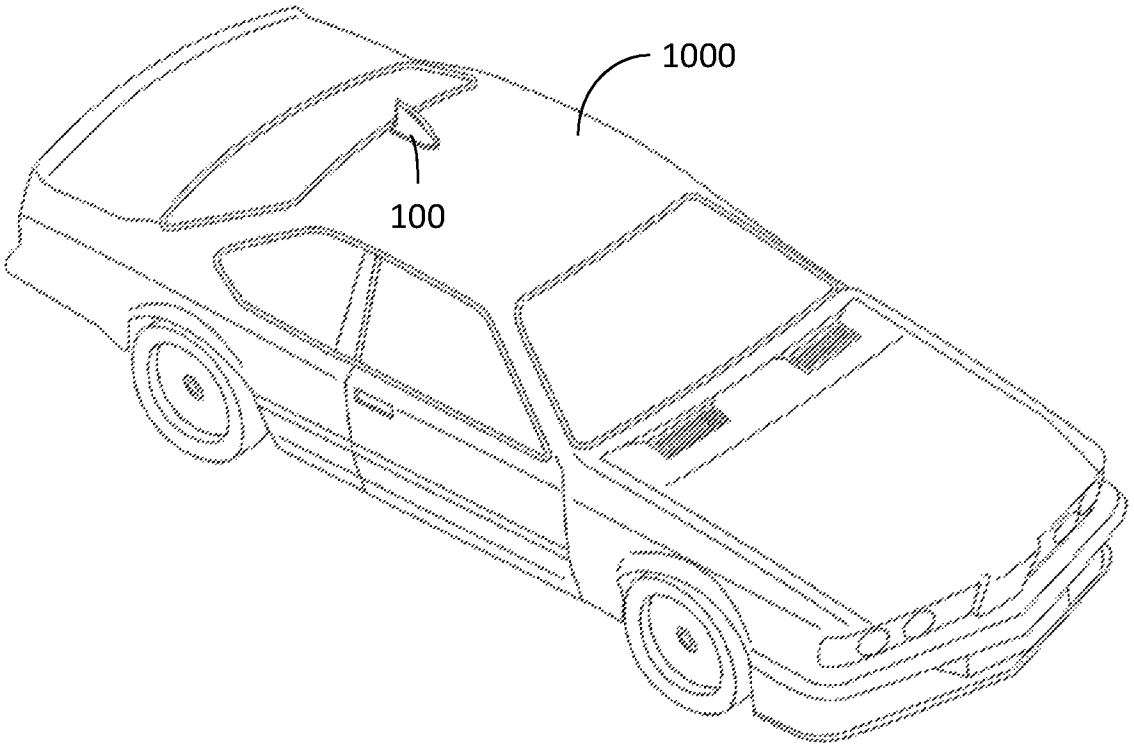
FIG. 10 is an isometric view of a car including the antenna assembly of FIG. 1 according to yet another example embodiment.

The antenna assemblies disclosed herein may be employed in various different applications. For example, the antenna assemblies may be used with vehicles. In such examples, the antenna assemblies may be coupled to a vehicle. Specifically, any one of the antenna assemblies may be coupled to a roof of a vehicle near a rear portion of the roof such that the camera installed in the antenna assembly captures a view behind the vehicle. This rear view of the vehicle may be displayed on the rearview mirror and/or another suitable vehicle display as explained above. For example, FIG. 10 illustrates one example of a car 1000 including the antenna assembly 100 of FIGS. 1 and 2 having its camera capturing a view behind the car 1000. This configuration can provide more visibility, a larger field of view, etc. for the operator of the car than a conventional rearview mirror, and therefore can replace the rearview mirror if desired.

The plugs disclosed herein may be formed into any suitable size and/or shape depending on, for example, a radome's opening. For example, the plugs may have a substantially circular shape to correspond to a substantially circular opening in a radome. In other examples, the plugs may have a substantially triangular shape, rectangular shape, etc. In some circumstances, it may be preferable to mass produce the plugs and the radomes with a consistent size and/or shape for part interchangeability.

Additionally, the plugs may be formed of any suitable material. For example, the plugs may be made of the same or a different material than the corresponding radome. Preferably, the plugs are made (e.g., injected molded) from a plastic material.

The seals disclosed herein may be formed into any suitable size and/or shape depending on, for example, the plug, the radome's opening, the camera, etc. For example, the seals may have a substantially circular shape, substantially triangular shape, rectangular shape, etc. In some examples, any one of the seals may have a particular outer perimeter shape to correspond to a particular plug and a particular inner perimeter shape (e.g., different than the outer perimeter shape) to correspond to a housing of the camera.

Further, the seals may be formed of any suitable material. For example, the seals may be made of a similar material or a different material than the corresponding plug. Preferably, the seals are made (e.g., overmolded) from a rubber, resilient material.

The radomes disclosed herein may have any suitable size. In some examples, the radomes may be sized to house one or more antennas including, for example, cellular antennas, GPS antennas, Wi-Fi antennas, radio (e.g., AM, FM, satellite) antennas, etc. Additionally, the radomes may include, for example, a shark fin shape (as shown in FIGS. 1 and 10) and/or another suitable shape.

The radomes, the plugs, and/or the seals disclosed herein may be painted the same or a different color. For example, a plug and/or a seal may be painted to match the color of a radome in an antenna assembly. As such, a radome, a plug and/or a seal of one antenna assembly may look like one uniform component.

By employing one or more of the features disclosed herein, the antenna assemblies may have improved sealing capabilities between a camera (e.g., a camera sensor, etc.) and a radome, an optimized camera location, an optimized tolerance, etc. compared to conventional radomes. Additionally, the antenna assemblies can be provided, assembled, manufactured, etc. with a simplified process which in turn reduces costs. For example, the camera of the antenna assemblies can be installed in a relatively straight line with respect to the plug and/or the seal (if employed) to simplify the assembly or manufacturing process, reduce unnecessary wear on components (e.g., the camera, the plug, the seal, etc.), etc. compared to conventional antenna assemblies.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a radome configured to house one or more antennas, the radome including an interior surface and an exterior surface opposing the interior surface, the radome defining an opening extending between the interior surface and the exterior surface;

a camera positionable at least partially within the opening of the radome, the camera and the radome defining a passage between the radome and the camera in the opening of the radome when the camera is positioned at least partially within the opening of the radome, the passage extending between the interior surface and the exterior surface of the radome;

a plug including an interior plug surface and an exterior plug surface opposing the interior plug surface, the plug defining an opening extending between the interior plug surface and the exterior plug surface to receive at least a portion of the camera, the plug positionable at least partially within the passage in the opening of the radome; and a flexible seal positionable at least partially within the opening of the radome, the flexible seal coupled between the camera and the plug, the plug and the flexible seal configured to substantially prevent contaminants from passing into the radome via the opening of the radome.

2. The antenna assembly of claim 1, wherein the radome includes one or more surfaces adjacent the opening of the radome and wherein the plug includes one or more flanges configured to detachably couple to the one or more surfaces of the radome.

3. The antenna assembly of claim 2, wherein the one or more flanges are resilient.

4. The antenna assembly of claim 1, wherein the passage extends substantially about the camera, and wherein the flexible seal extends completely around an outer perimeter of the camera and an inner perimeter of the plug, whereby a friction fit is provided between the flexible seal and a casing of the camera.

5. The antenna assembly of claim 1, wherein the antenna assembly is configured to couple to a vehicle, and wherein the flexible seal includes outwardly protruding bumps that extend outwardly from opposing sides of the flexible seal and that are compressed against the camera when the camera is positioned at least partially within the opening of the radome.

6. The antenna assembly of claim 1, further comprising one or more antennas housed within the radome, wherein the flexible seal comprises a resilient material overmolded directly onto the plug.

7. The antenna assembly of claim 1, wherein the camera is substantially flush with the exterior surface of the radome when positioned at least partially within the opening of the radome.

8. The antenna assembly of claim 1, further comprising a circuit board coupled to the camera, the circuit board configured to couple to the interior surface of the radome.

9. The antenna assembly of claim 8, wherein:

the circuit board is a first circuit board; and the antenna assembly further comprising a second circuit board coupled to the first circuit board, the second circuit board including a control circuit configured to receive one or more signals from the camera.

10. The antenna assembly of claim 9, wherein the control circuit is configured to provide one or more signals to a display.

11. The antenna assembly of claim 9, further comprising a third circuit board coupling the second circuit board to the first circuit board.

12. The antenna assembly of claim 11, wherein:

the first circuit board and the second circuit board are rigid circuit boards; and the third circuit board is a flexible circuit board.

13. The antenna assembly of claim 12, further comprising a chassis configured to support the radome, wherein the second circuit board is configured to couple to the chassis.

14. A method comprising:

coupling a camera to a chassis of an antenna assembly;

mounting a radome of the antenna assembly to the chassis such that the camera is at least partially within an opening of the radome extending between an interior surface and an exterior surface of the radome, the radome configured to house one or more antennas;

coupling a plug to the radome such that the plug is at least partially within the opening of the radome and at least partially within a passage in the opening of the radome defined by the radome and the camera and such that the plug at least partially surrounds the camera, the passage extending between the interior surface and the exterior surface of the radome; and coupling a flexible seal between the camera and the plug such that the flexible seal is at least partially within the opening of the radome, whereby the plug and the flexible seal substantially prevent contaminants from passing into the radome via the opening of the radome.

15. The method of claim 14, wherein coupling the flexible seal to the plug includes overmolding the flexible seal onto the plug.

16. The method of claim 15, wherein overmolding the flexible seal includes overmolding the flexible seal onto the plug before coupling the plug to the radome.

17. The method of claim 14, wherein coupling the plug includes coupling the plug to the radome after mounting the radome to the chassis.

18. The method of claim 14, wherein coupling the plug to the radome includes coupling the plug to the radome such that the camera is substantially flush with an exterior surface of the radome.

19. The method of claim 14, wherein coupling the camera includes coupling a circuit board including the camera to the chassis.

20. The method of claim 14, wherein coupling the plug to the radome includes detachably coupling the plug to the radome.

* * * * *